US008651077B2

(12) United States Patent
Matsunaga

(10) Patent No.: US 8,651,077 B2
(45) Date of Patent: Feb. 18, 2014

(54) FLUID-PRESSURE-OPERATED VALVE TIMING CONTROLLER

(75) Inventor: Yuuki Matsunaga, Chiryu (JP)

(73) Assignee: Denso Corporation, Kariya (JP)

( * ) Notice: Subject to any disclaimer, the term of this patent is extended or adjusted under 35 U.S.C. 154(b) by 3 days.

(21) Appl. No.: 13/611,052

(22) Filed: Sep. 12, 2012

(65) Prior Publication Data

US 2013/0098320 A1 Apr. 25, 2013

(30) Foreign Application Priority Data

Oct. 25, 2011 (JP) ..... 2011-234390

(51) Int. Cl.
*F01L 1/34* (2006.01)

(52) U.S. Cl.
USPC ..... 123/90.17; 123/90.15; 123/90.65

(58) Field of Classification Search
USPC ..... 123/90.15, 90.17, 90.65
See application file for complete search history.

(56) References Cited

U.S. PATENT DOCUMENTS 7,603,975 B2 * 10/2009 Sugiura et al. ..... 123/90.17
2011/0073056 A1 3/2011 Kobayashi et al.

* cited by examiner

*Primary Examiner* — Ching Chang
(74) *Attorney, Agent, or Firm* — Nixon & Vanderhye PC

(57) ABSTRACT

A fluid-pressure-operated valve timing controller includes an outer rotor, an inner rotor, and a spiral spring constructed by an element wire spirally extending. The spiral spring biases the inner rotor in a biasing direction when the spiral spring twistingly deforms in accordance with sliding rotation of the inner rotor in a deformation direction relative to the outer rotor. The spiral spring has a bent part bent to protrude in a radial direction. The bent part of the spiral spring is linearly contact with a part of the element wire located adjacent to the bent part in the radial direction.

6 Claims, 6 Drawing Sheets

FLUID-PRESSURE-OPERATED VALVE TIMING CONTROLLER

CROSS REFERENCE TO RELATED APPLICATION

This application is based on Japanese Patent Application No. 2011-234390 filed on Oct. 25, 2011, the disclosure of which is incorporated herein by reference in its entirety.

TECHNICAL FIELD

The present disclosure relates to a fluid-pressure-operated valve timing controller.

BACKGROUND

JP-2011-69316A (US 2011/0073056) describes a fluid-pressure-operated valve timing controller having an outer rotor rotating with a crankshaft and an inner rotor rotating with a camshaft inside of the outer rotor. The inner rotor defines operation chambers inside the outer rotor, and the operation chambers are arranged in a circumference direction. The inner rotor is slidably rotated in the circumference direction relative to the outer rotor by working fluid flowing into or out of the operation chambers, thus the valve timing can be controlled in accordance with relative rotation between the inner rotor and the outer rotor.

The valve timing controller has an element wire that spirally extends to form a spiral spring. The most outside circumference part of the wire is supported by the outer rotor, and the most inside circumference part of the wire is supported by the inner rotor. The spiral spring is twistingly deformed by rotation of the inner rotor in a deformation direction relative to the outer rotor, thereby biasing the inner rotor in a biasing direction opposite from the deformation direction relative to the outer rotor. Therefore, when the supply of working fluid is stopped to the operating chambers in a case where an engine is stopped, the spiral spring rotates the inner rotor in the biasing direction relative to the outer rotor. Thus, the valve timing that is suitable for the start-up of the engine can be compulsorily realized.

Generally, the engine has vibration by the rotation, and the frequency of vibrations is increased by increase in the rotation speed of the engine. If the frequency of vibrations is increased to be equal to a natural frequency of vibration of the spiral spring, resonance will occur in the spiral spring. As a result, stress applied to the spiral spring is rapidly increased, and the spiral spring may have a failure such as bending or crack.

Because the element wire extends spirally, a part of the wire is located adjacent with other part of the wire in the radial direction. The part of the wire and the other part of the wire are just in contact by only bringing the most outside circumference part inward in the radial direction, and are easily separated from each other when the spiral spring is twistingly deformed. In this case, the natural frequency of the spiral spring is reduced, and the resonance becomes easy to be generated in the spiral spring.

Moreover, while the most outside circumference part is brought inward at the contact position in the radial direction, the element wire may be tensioned outward in the radial direction at a position different from the contact position, and excessive stress is easily generated.

Furthermore, unnecessary force is applied in the radial direction to the most inside circumference part that is supported by the inner rotor, when the most outside circumference part is brought inward in the radial direction. At this time, a contact resistance generated between the inner rotor and the outer rotor is increased, and the responsivity of the valve timing may be lowered.

SUMMARY

It is an object of the present disclosure to provide a fluid-pressure-operated valve timing controller having high endurance and high responsivity.

According to an example of the present disclosure, a fluid-pressure-operated valve timing controller controls a valve timing of a valve opened/closed by a torque transmitted to a camshaft from a crankshaft of an internal combustion engine using working fluid, and includes an outer rotor, an inner rotor and a spiral spring. The outer rotor is rotatable synchronously with the crankshaft. The inner rotor is rotatable synchronously with the camshaft, and partitions an inside space of the outer rotor into a plurality of working chambers in a circumference direction. The inner rotor slidably rotates in the circumference direction relative to the outer rotor using a flow of the working fluid relative to the working chambers. The spiral spring is constructed by an element wire spirally extending. The element wire has a most outer circumference part supported by the outer rotor at a first position and a most inner circumference part supported by the inner rotor at a second position. The circumference direction has a deformation direction and a biasing direction opposite from each other. The spiral spring biases the inner rotor in the biasing direction relative to the outer rotor by twistingly deforming in accordance with rotation of the inner rotor in the deformation direction relative to the outer rotor. The spiral spring has a bent part bent to protrude in a radial direction between the first position and the second position, and the bent part of the spiral spring is linearly contact with a part of the element wire located adjacent to the bent part in the radial direction.

Accordingly, the fluid-pressure-operated valve timing controller has high endurance and high responsivity.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
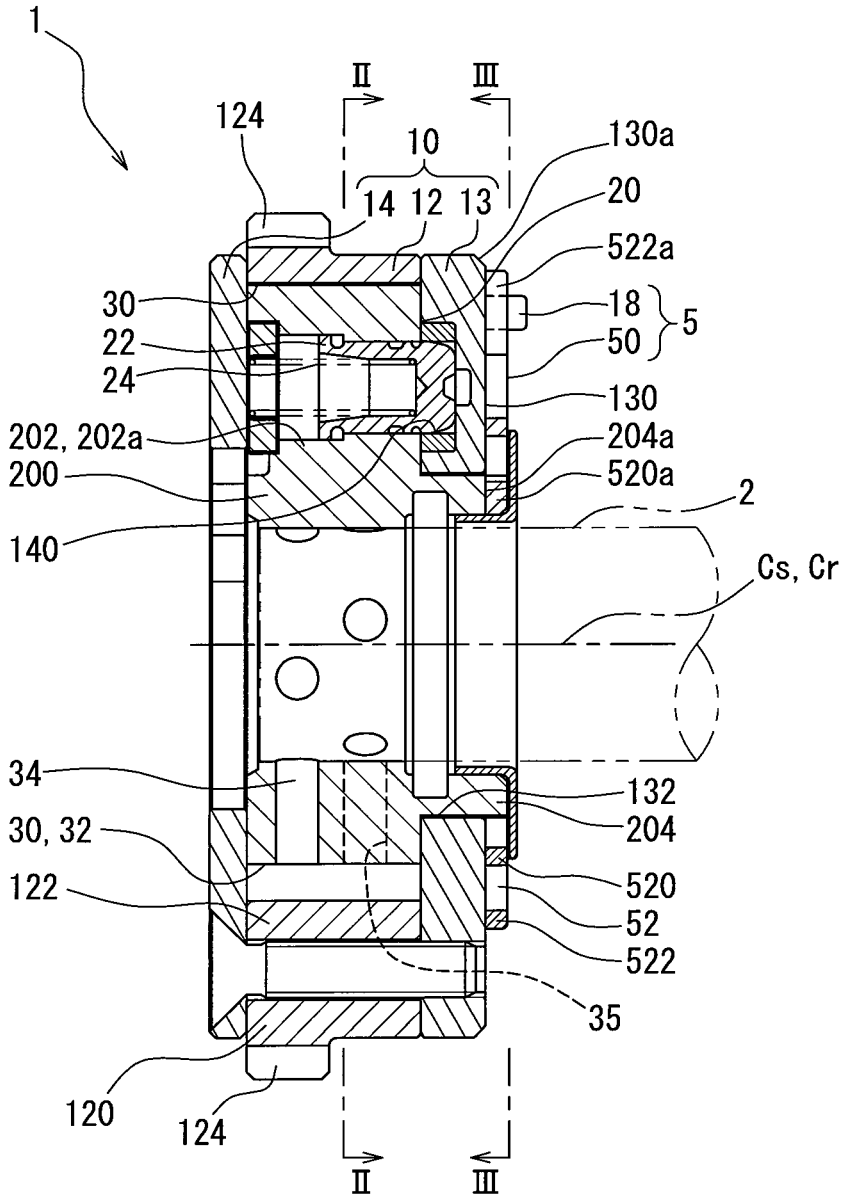
FIG. 1 is a cross-sectional view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A valve timing controller 1 according to a first embodiment is applied to an internal combustion engine for a vehicle. The controller 1 is disposed in a transmission system in which a torque of the engine is transmitted to a camshaft 2 from a crankshaft (not shown). The valve timing controller 1 controls a valve timing of an exhaust valve which is driven by the camshaft 2 using working fluid such as oil.

Figure 2:
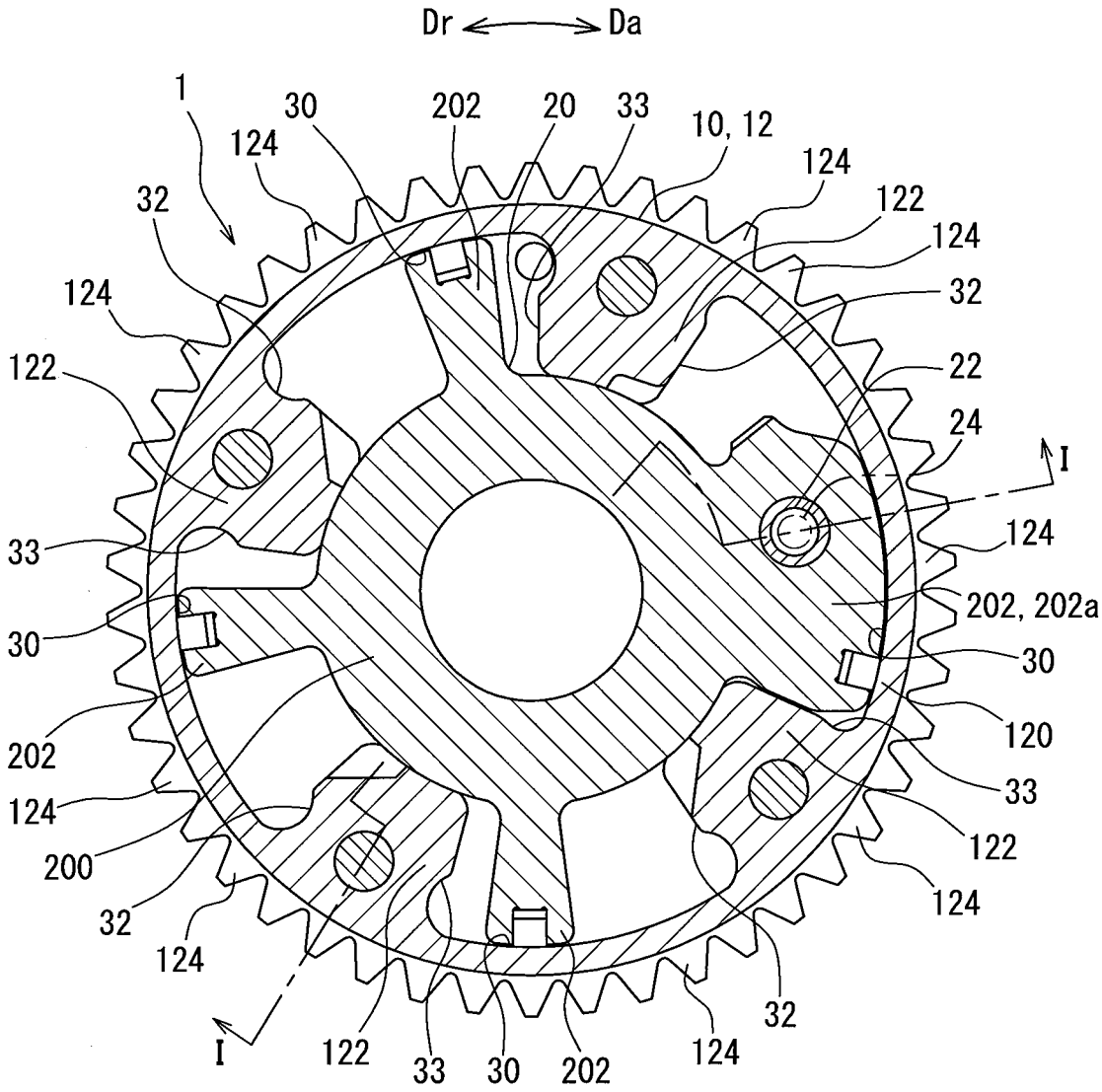
FIG. 2 is a cross-sectional view taken along a line II-II of FIG. 1.

As shown in FIGS. 1 and 2, the valve timing controller 1 has an outer rotor 10 and an inner rotor 20, and controls the valve timing by changing a rotation phase of the inner rotor 20 relative to the outer rotor 10. The outer rotor 10 and the inner rotor 20 have a common circumference direction, a common radial direction, and a common axis direction. Moreover, the rotation phase of the inner rotor 20 relative to the outer rotor 10 may be referred as a rotation phase between the rotors 10 and 20.

The outer rotor 10 includes a housing 12 having sprocket teeth 124, and a rear plate 13 and a front plate 14 respectively tightened to ends of the housing 12 in the axis direction. The outer rotor 10 may be referred as a sprocket housing.

The housing 12 has a peripheral wall 120, plural shoes 122 arranged in the circumference direction at equal intervals, and the sprocket teeth 124. Each of the shoes 122 is radially inwardly projected from an inner surface of the peripheral wall 120. An accommodation chamber 30 is defined between the adjacent shoes 122 located adjacent with each other in the circumference direction.

Each of the sprocket teeth 124 is projected outward in the radial direction from the wall 120, and the teeth 124 are located with regular intervals in the circumference direction. A timing chain (not shown) is arranged between the sprocket teeth 124 and teeth of the crankshaft, so that the housing 12 is linked with the crankshaft. When the engine is rotated, the engine torque output from the crankshaft is transmitted to the housing 12 through the timing chain, and the outer rotor 10 is rotated in response to the rotation of the crankshaft in a clockwise direction of FIG. 2.

The inner rotor 20 is coaxially interposed between the plates 13 and 14 inside the outer rotor 10. The inner rotor 20 may be referred as a vane rotor. The inner rotor 20 includes a rotation shaft 200 and plural vanes 202. The cylindrical rotation shaft 200 is accommodated in the outer rotor 10, and a first end of the shaft 200 is slidably contact with the front plate 14. A second end of the rotation shaft 200 is projected outward from the outer rotor 10 through a center (main) hole 132 of the rear plate 13, thereby defining a projection 204 that is coaxially tightened with the camshaft 2. The inner rotor 20 is rotatable in both sides in the circumference direction relative to the outer rotor 10 while the inner rotor 20 is rotated in the clockwise direction of FIG. 2 together with the camshaft 2.

Each of the vanes 202 projects radially outwardly from the shaft 200 at regular intervals in the circumference direction, and is accommodated in the corresponding chamber 30. Both ends of the vane 202 in the axis direction slidably contact with the plates 13 and 14, respectively. A projection-side end of the vane 202 in the radial direction is slidably contact the inner circumference part of the housing 12.

Each vane 202 partitions the accommodation chamber 30 in the circumference direction, thereby defining an advance chamber 32 and a retard chamber 33. Working fluid flows into or out of the advance chamber 32 and the retard chamber 33 through an advance passage 34 and a retard passage 35, respectively.

When working fluid is introduced into the advance chamber 32 through the advance passage 34 penetrating the rotation shaft 200, a rotation torque is generated to rotate the inner rotor 20 in an advance direction Da relative to the outer rotor 10. On the other hand, when working fluid is introduced into the retard chamber 33 through the retard passage 35 penetrating the rotation shaft 200, a rotation torque is generated to rotate the inner rotor 20 in a retard direction Dr relative to the outer rotor 10.

One of the vanes 202 (referred as a predetermined vane 202*a*) includes a lock component 22 and a lock spring 24. As shown in FIG. 1, the lock component 22 has a columnar pin shape, and is biased by the lock spring 24. The lock component 22 is fitted into a cylindrical lock hole 140 defined in the rear plate 13 so as to lock the inner rotor 20. Thus, the inner rotor 20 becomes impossible to have relative rotation relative to the outer rotor 10. When the inner rotor 20 is locked, the rotation phase between the rotors 10 and 20 is set into the most advance phase of FIG. 2 which is the optimal at the engine stop time, as a lock phase.

On the other hand, the lock component 22 is separated from the lock hole 140 by receiving the pressure of working fluid in at least one of the chambers 32 and 33 opposing with each other through the vane 202*a* in the circumference direction, thereby canceling the lock of the inner rotor 20.

While the inner rotor 20 is unlocked, when working fluid is introduced into each advance chamber 32 and is discharged from each retard chamber 33, the inner rotor 20 rotates in the advance direction Da relative to the outer rotor 10. As a result, the rotation phase between the rotors 10, 20 is changed in the advance direction, and accordingly the valve timing is advanced.

While the inner rotor 20 is unlocked, when working fluid is introduced into each retard chamber 33 and is discharged from each advance chamber 32, the inner rotor 20 rotates in the retard direction Dr relative to the outer rotor 10. As a result, the rotation phase between the rotors 10, 20 is changed in the retard direction, and accordingly the valve timing is retarded.

Figure 3:
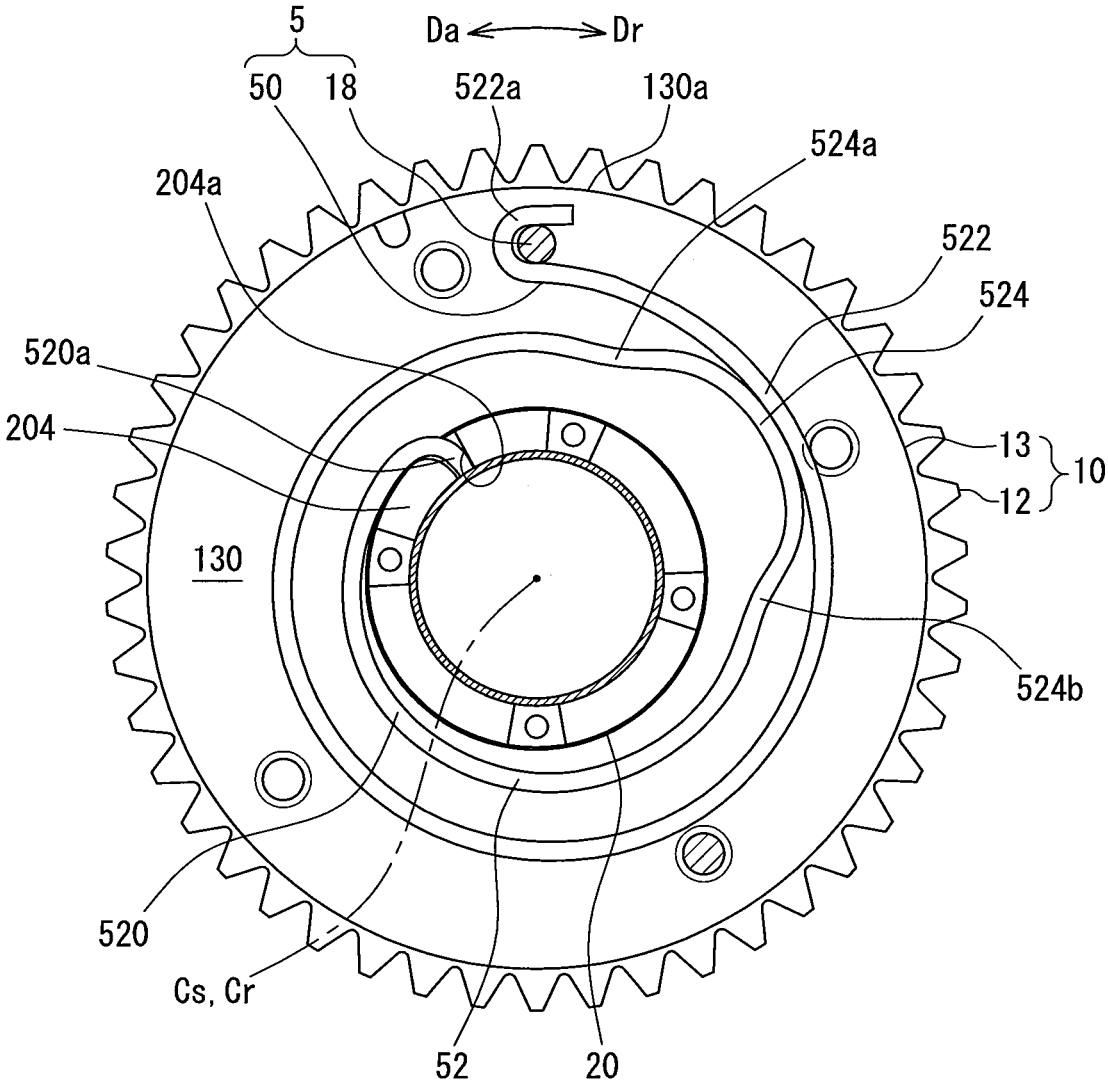
FIG. 3 is a cross-sectional view taken along a line III-III of FIG. 1.

The valve timing controller 1 further includes a biasing unit 5 having an outer stopper 18 and a spiral spring 50, as shown in FIGS. 1 and 3, to bias the inner rotor 20 toward the lock phase. The outer rotor 10 made of metal has the outer stopper 18 projected from the rear plate 13 away from the housing 12 in the axis direction. The outer stopper 18 is eccentrically disposed by a predetermined distance in the radial direction from a common rotation center Cr of the rotors 10 and 20, and has a pillar pin shape.

The spiral spring 50 is arranged around the projection 204 of the shaft 200 of the inner rotor 20 made of metal. The spiral spring 50 may be a torsion spring defined by winding a metal element wire 52 spirally within a substantially the same plane. The spiral spring 50 is arranged in a manner that a center Cs of the spiral spring 50 corresponds to the rotation center Cr of the rotors 10 and 20. The spiral spring 50 contacts an outer end surface 130 of the rear plate 13 opposite from the housing 12 in the axis direction.

The most inner circumference part 520 of the spiral spring 50 surrounds the projection 204 from the outer side in the radial direction. A tip end 520*a* of the most inner circumference part 520 is bent to have an L-shape inward in the radial direction, and is supported by the inner rotor 20 by being fitted into a fitting hole 204*a* defined in the projection 204. The tip end 520*a* may correspond to a first position.

The most outer circumference part 522 of the spiral spring 50 is arranged on an inner side of an outer edge 130*a* of the outer end surface 130 of the rear plate 13 in the radial direction. Therefore, whole of the spiral spring 50 is received on the inner side of the outer edge 130*a* in the radial direction. A tip end 522*a* of the most outer circumference part 522 is bent outward in the radial direction to have an U-shape, and the outer stopper 18 is fitted with the inside of the U-shaped tip end 522*a*. Thereby, the tip end 522*a* is supported by the outer rotor 10. The tip end 522*a* may correspond to a second position.

As shown in FIG. 3, the spiral spring 50 has a bent part 524 by bending the element wire 52 to protrude outward in the radial direction. The bent part 24 is located between the tip end 522*a* supported by the outer rotor 10 and the tip end 520*a* supported by the inner rotor 20. The bent part 524 has an arch shape smoothly curved to protrude outward in the radial direction. The bent part 524 of this embodiment is formed to linearly contact with the most outer circumference part 522 within a predetermined angle range in the circumference direction when the bent part 524 and the most outer circumference part 522 are located adjacent with each other in the radial direction.

The most inner circumference part 520 is supported by the inner rotor 20 and the most outer circumference part 522 is supported by the outer rotor 10, in all of the movable range for the rotation phase between the rotors 10 and 20. Therefore, the spiral spring 50, in which the bent part 524 and the most outer circumference part 522 are linearly contact with each other in the radial direction, generates a restoring force by twistingly deforming in accordance with the rotation phase between the rotors 10 and 20.

As a result, the inner rotor 20 receives the restoring force generated in the spiral spring 50 as a biasing force biasing in the advance direction Da. That is, when the spiral spring 50 has the twisting deformation in accordance with rotation of the inner rotor 20 relative to the outer rotor 10 in the retard direction Dr (deformation direction), the inner rotor 20 is biased in the advance direction Da (biasing direction).

According to the first embodiment, the most outer circumference part 522 of the element wire 52 is supported by the outer rotor 10, and the most inner circumference part 520 of the element wire 52 is supported by the inner rotor 20. The bent part 524 bent to protrude outward in the radial direction between the tip end 522*a* and the tip end 520*a* is linearly contact with the most outer circumference part 522 located adjacent to the bent part 524 in the radial direction.

Therefore, the length of the element wire 52, which receives the vibration of the engine, becomes short between the tip end 522*a*, 520*a* and the contact position at which the bent part 524 and the most outer circumference part 522 are linearly contact with each other. Thereby, a primary natural frequency of vibration of the spiral spring 50 is increased. Accordingly, even if the frequency of vibrations is increased in the engine by increase in the rotation speed of the engine, it is possible to restrict the spiral spring 50 from having resonance, because the spiral spring 50 is provided, in advance, with the primary natural frequency of vibrations larger than a maximum value estimated for the engine.

According to the embodiment, it becomes unnecessary to bring the most outer circumference part 522 inward in the radial direction, due to the bent part 524. Accordingly, the element wire 52 is restricted from receiving excessive stress, and a contact resistance between the rotors 10 and 20 is restricted from increasing by eliminating unnecessary force applied to the most inner circumference part 520 in the radial direction.

The endurance of the spiral spring 50 is improved by restricting the resonance and the excessive stress. Further, torque loss can be reduced by reducing the resistance between the rotors 10 and 20. Thus, the responsivity of the valve timing can be raised.

As shown in FIG. 3, the bent part 524 has a first end 524*a* and a second end 524*b*, and a smoothly curved arch shape is defined between the first end 524*a* and the second end 524*b*. Therefore, variation in the curvature can be reduced in the both ends 524*a* and 524*b* of the bent part 524. Thus, the both ends 524*a* and 524*b* of the bent part 524 are restricted from having excessive stress when the spiral spring 50 is twistingly deformed. Accordingly, the durability of the spiral spring 50 can be much raised.

Furthermore, the spiral spring 50 of the biasing unit 5 is arranged on the inner side in the radial direction rather than the outer edge 130*a* of the outer end surface 130 of the outer rotor 10. Because the element wire 52 is restricted from being tensioned outward in the radial direction by the linear contact structure between the bent part 524 and the most outer circumference part 522, the spiral spring 50 is restricted from protruding outward in the radial direction from the outer edge 130*a*. Therefore, it also becomes possible to reduce the size of the valve timing controller 1 while the high durability and high responsivity are achieved.

(Second Embodiment)

Figure 4:
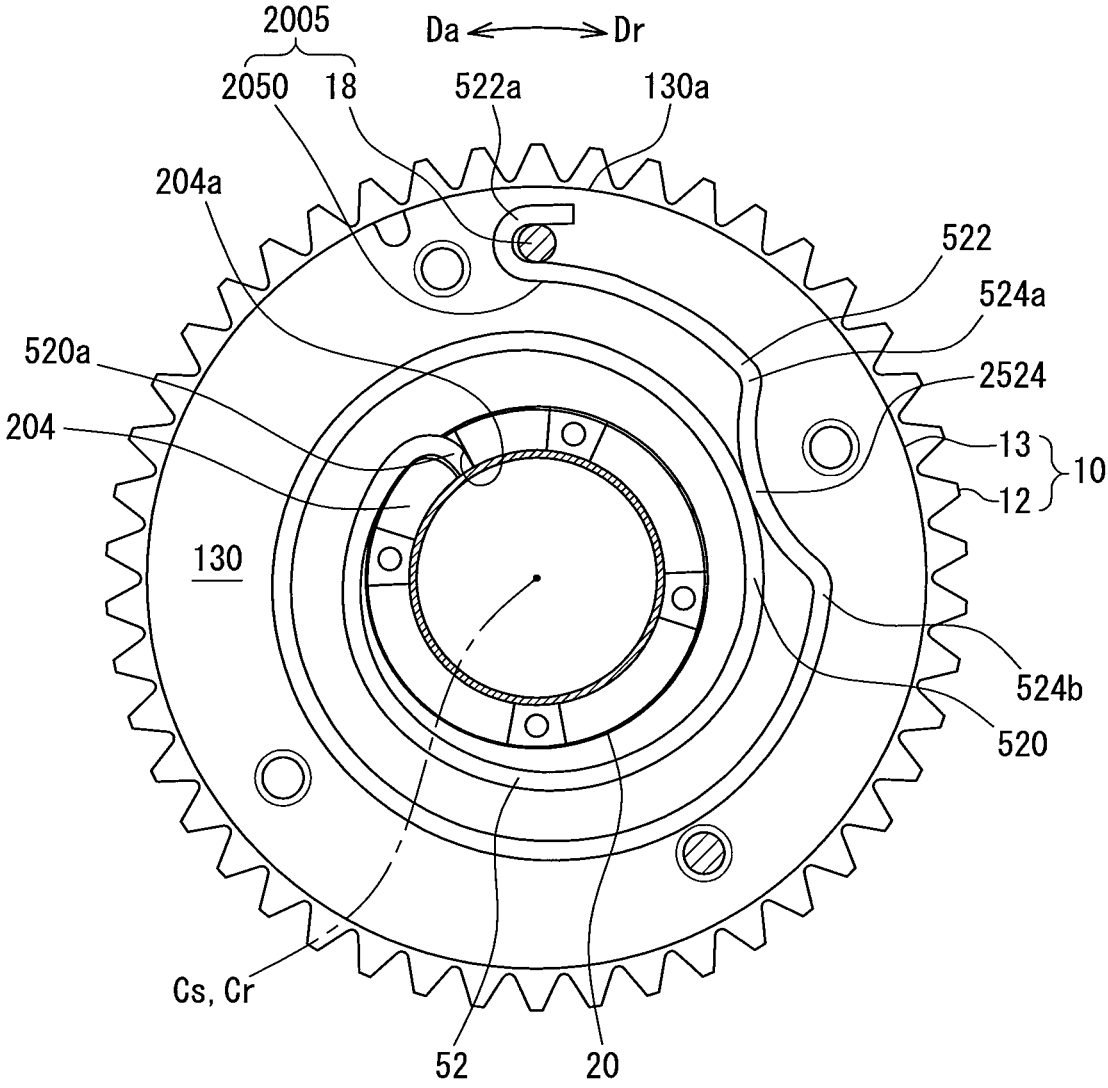
FIG. 4 is a cross-sectional view illustrating a valve timing controller according to a second embodiment.

A second embodiment, which is a modification example of the first embodiment, will be described with reference to FIG. 4. A spiral spring 2050 of a biasing unit 2005 has a bent part 2524 defined by bending the element wire 52 to protrude inward in the radial direction at a position between the tip end 522*a* of the most outer circumference part 522 and the tip end 520*a* of the most inner circumference part 520.

The bent part 2524 has a smooth arch shape, and is linearly contact with the most inner circumference part 520 that is located adjacent to the bent part 2524 in the radial direction. The contact position, at which the bent part 2524 and the most inner circumference part 520 are linearly contact with each other, is located at a predetermined position in the circumference direction.

The spiral spring 2050 generates a restoring force biasing the inner rotor 20 in accordance with the rotation phase between the rotors 10 and 20 in the state where the bent part 2524 and the most inner circumference part 520 are in the linear contact with each other. Thus, approximately the same advantages can be obtained in the second embodiment as the first embodiment.

(Third Embodiment)

Figure 5:
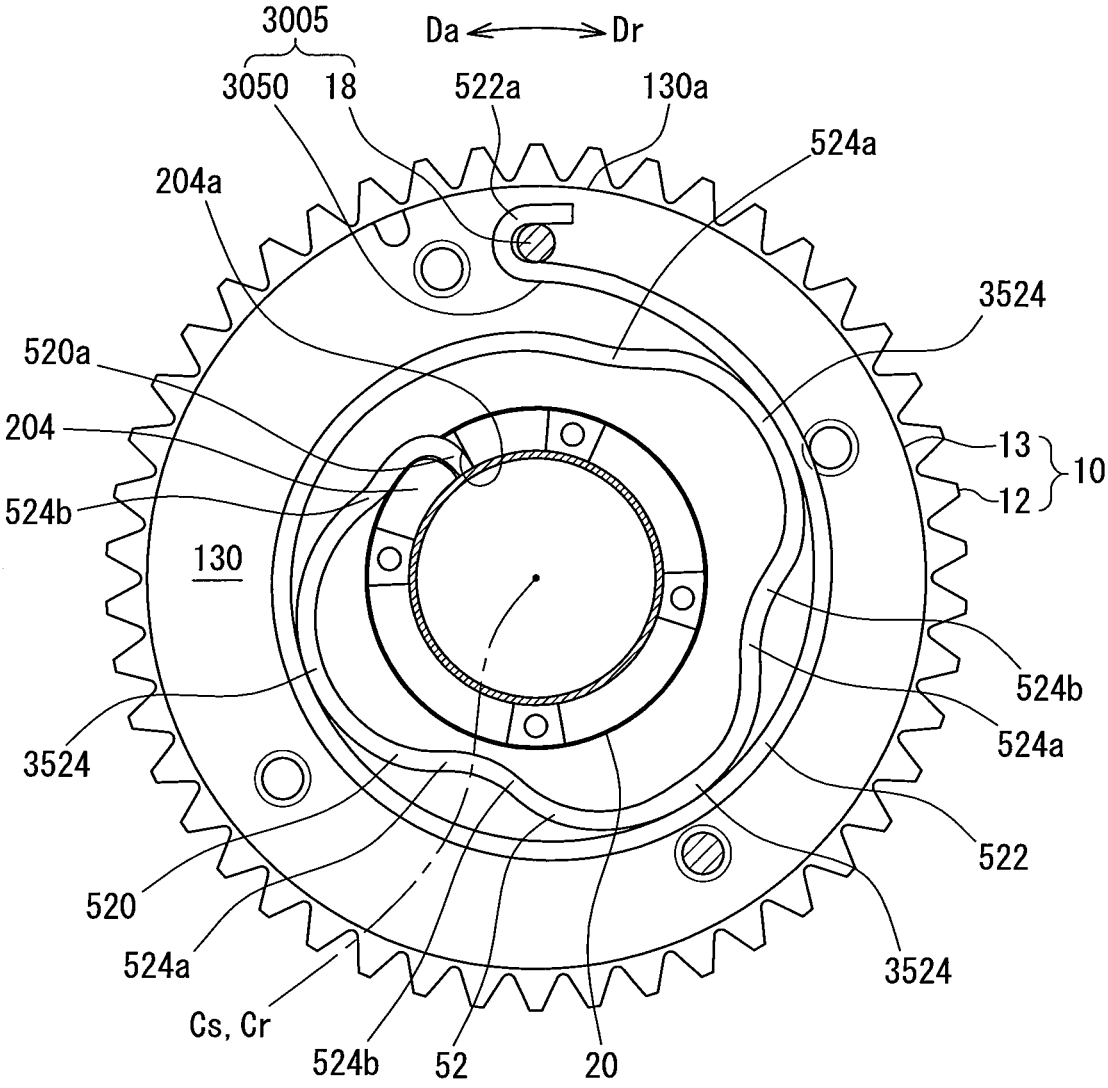
FIG. 5 is a cross-sectional view illustrating a valve timing controller according to a third embodiment.

A third embodiment, which is a modification example of the first embodiment, will be described with reference to FIG. 5. A spiral spring 3050 of a biasing unit 3005 has plural (such as three) bent parts 3524 defined by bending the element wire 52 to protrude outward in the radial direction at positions between the tip end 522*a* of the most outer circumference part 522 and the tip end 520*a* of the most inner circumference part 520. Each of the bent parts 3524 has a smooth arch shape, and is linearly contact with the most outer circumference part 522 that is located adjacent to the bent part 3524 in the radial direction. The contact position, at which the bent part 3524 and the most inner circumference part 520 are linearly contact with each other, is located at a predetermined position in the circumference direction.

The spiral spring 3050 generates a restoring force biasing the inner rotor 20 in accordance with the rotation phase between the rotors 10 and 20 in the state where the bent parts 3524 and the most outer circumference part 522 are in the linear contact with each other.

Therefore, the length of the element wire 52, which receives the vibration of the engine, can be made short between the linear contact positions at which the bent part 3524 and the most outer circumference part 522 are contact with each other. Further, the length of the element wire, which receives the vibration of the engine, can be made short between the tip end 522*a*, 520*a* and the linear contact position located immediately adjacent to the tip end 522*a*, 520*a* in the circumference direction. Thus, the primary natural frequency of vibration of the spiral spring 3050 can be securely increased to restrict the resonance. Accordingly, the high endurance can be achieved.

(Fourth Embodiment)

Figure 6:
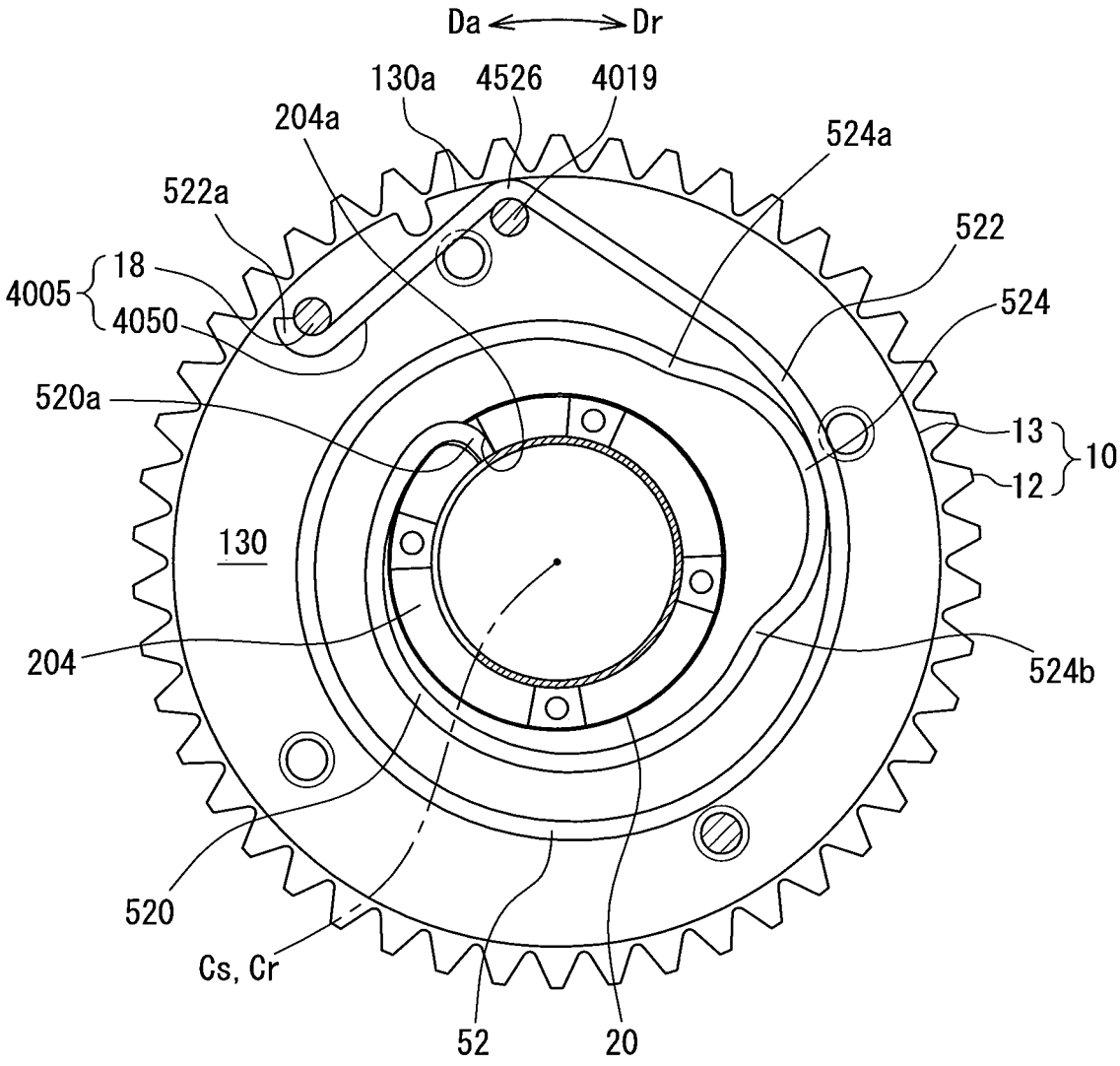
FIG. 6 is a cross-sectional view illustrating a valve timing controller according to a fourth embodiment.

A fourth embodiment, which is a modification example of the first embodiment, will be described with reference to FIG. 6. A biasing unit 4005 further includes a support member 4019 in addition to a spiral spring 4050 and the outer stopper 18. The support member 4019 has a columnar pin shape protruding outward from the rear plate 13 of the outer rotor 10 in the axis direction away from the housing 12. The support member 4019 is distanced from the rotation center Cr in the radial direction by a predetermined interval. A distance between the rotation center Cr and the support member 4019 in the radial direction is larger than a distance between the rotation center Cr and the outer stopper 18. The support member 4019 is located at a third position offset from the outer stopper 18 in the circumference direction on the retard side.

The most outer circumference part 522 of the spiral spring 4050 of the biasing unit 4005 has a support part 4526 which is defined by bending the element wire 52 to protrude outward in the radial direction at a position shifted from the tip end 522*a* on the retard side in the circumference direction. The support part 4526 is bent to have a crest shape protruding outward in the radial direction, and the support member 4019 is fitted with the inner side of the crest-shaped support part 4526. Thus, the support part 4526 is supported by the outer rotor 10 through the support member 4019 from the inner side in the radial direction.

Further, whole of the spiral spring 4050 is stored on the inner side in the radial direction from the outer edge 130*a*, because the support part 4526 is arranged on the inner side in the radial direction rather than the outer edge 130*a* of the outer end surface 130 of the rear plate 13.

Furthermore, the support part 4526 is located between the tip end 522*a* and a part of the most outer circumference part 522 linearly contacting with the bent part 524 in the circumference direction.

According to the fourth embodiment, because the support part 4526 is supported by the outer rotor 10 from the inner side in the radial direction, the most outer circumference part 522 is restricted from moving inward in the radial direction when the spiral spring 4050 has a twisting deformation.

Thus, the element wire 52 is restricted from having excessive stress by tension applied outward in the radial direction. Further, the most inner circumference part 520 is restricted from receiving unnecessary force in the radial direction, therefore the contact resistance between the rotors 10 and 20 can be restricted from increasing. Accordingly, high durability and high responsivity can be achieved.

(Other Embodiments)

The present disclosure should not be limited to the above embodiments, and may be implemented in other ways without departing from the sprit of the disclosure.

The bent part 524, 2524, 3524 may have a crest shape similarly to the support part 4526 of the fourth embodiment.

Moreover, in the first, third and fourth embodiments, the bent part 524, 3524 may be linearly contact with the element wire 52 located on the inner side in the radial direction rather than the most outer circumference part 522. In the second embodiment, the bent part 2524 may be linearly contact with the element wire 52 located on the outer side in the radial direction rather than the most inner circumference part 520.

Furthermore, in the third and fourth embodiments, the bent part 524, 3524 may protrude inward in the radial direction, similarly to the second embodiment. In the case of the third embodiment, all or some of the bent parts 3524 may protrude inward in the radial direction.

In the fourth embodiment, the support part 4526 may be defined at plural positions shifted from the tip end 522*a* in the circumference direction. In addition, in the fourth embodiment, a part of the most outer circumference part 522, that is not bent, may be supported by the support member 4019 from the inner side in the radial direction.

The spiral spring 50, 2050, 3050, 4050 may be arranged to protrude outward in the radial direction from the outer edge 130*a* of the outer end surface 130 of the outer rotor 10 adjacent to the spiral spring 50, 2050, 3050, 4050 in the axis direction.

Furthermore, in the first to fourth embodiments, the lock phase may be set into a rotation phase between the most advance phase and the most retard phase. In this case, the range of the rotation phase, in which the inner rotor 20 receives the biasing force from the spiral spring 50, 2050, 3050, 4050, may be limited into a range from the most advance phase or the most retard phase to the lock phase.

In the first to fourth embodiments, the valve opened/closed by the camshaft 2 may be an intake valve instead of the exhaust valve. In this case, the relationship between "advance" and "retard" is made reverse, and the inner rotor 20 is biased in the retard direction Dr by the spiral spring 50, 2050, 3050, 4050.

Such changes and modifications are to be understood as being within the scope of the present disclosure as defined by the appended claims.

What is claimed is:

1. A fluid-pressure-operated valve timing controller controlling a valve timing of a valve opened and closed by a torque transmitted to a camshaft from a crankshaft of an internal combustion engine using working fluid, the valve timing controller comprising:

an outer rotor rotating with the crankshaft;

an inner rotor rotating with the camshaft, the inner rotor partitioning an inside space of the outer rotor into a plurality of working chambers in a circumference direction, the inner rotor slidably rotating in the circumference direction relative to the outer rotor using a flow of the working fluid relative to the working chambers; and a spiral spring constructed by an element wire spirally extending, the element wire having a most outer circumference part supported by the outer rotor at a first position and a most inner circumference part supported by the inner rotor at a second position, the circumference direction having a deformation direction and a biasing direction opposite from each other, wherein the spiral spring has a twisting deformation when the inner rotor slidably rotates in the deformation direction relative to the outer rotor, the spiral spring biases the inner rotor in the biasing direction relative to the outer rotor when the spiral spring has the twisting deformation, the spiral spring has a bent part bent to protrude in a radial direction between the first position and the second position, and the bent part of the spiral spring is linearly contact with a part of the element wire located adjacent to the bent part in the radial direction.

2. The fluid-pressure-operated valve timing controller according to claim 1, wherein the bent part has a curved arch shape by bending the element wire of the spiral spring.

3. The fluid-pressure-operated valve timing controller according to claim 1, wherein the bent part is one of a plurality of bent parts arranged between the first position and the second position.

4. The fluid-pressure-operated valve timing controller according to claim 1, wherein the most outer circumference part is supported by the outer rotor from an inner side in the radial direction at a third position offset from the first position in the circumference direction.

5. The fluid-pressure-operated valve timing controller according to claim 4, wherein the most outer circumference part has a support part supported by the outer rotor from the inner side in the radial direction, and the support part is defined by bending the element wire to protrude outward in the radial direction.

6. The fluid-pressure-operated valve timing controller according to claim 1, wherein the outer rotor has an end surface in an axis direction, and the spiral spring is arranged on an inner side in the radial direction from an outer edge of the end surface of the outer rotor.

* * * * *